United States Patent [19]

Seiden

[11] 4,281,835

[45] Aug. 4, 1981

[54] ARITHMETIC CARD GAME METHOD

[76] Inventor: Nat Seiden, 15-5 Civic Center, E. Brunswick, N.J. 08816

[21] Appl. No.: 63,604

[22] Filed: Aug. 3, 1979

[51] Int. Cl.[3] ..... A63F 1/00

[52] U.S. Cl. ..... 273/299; 434/191

[58] Field of Search ..... 273/299; 35/31 G, 70; 434/191, 208

[56] References Cited

U.S. PATENT DOCUMENTS 1,528,061 3/1925 Joyce ..... 273/299 X

FOREIGN PATENT DOCUMENTS 860109 2/1961 United Kingdom ..... 273/299

OTHER PUBLICATIONS

"Games with Playing Cards", by Joseph Leeming, publ. by Franklin Watts, Inc., N. Y., ©1949, pp. 67–73.

*Primary Examiner*—Anton O. Oechsle

*Attorney, Agent, or Firm*—Robert D. Farkas

[57] ABSTRACT

A game method and apparatus utilizes a first and second plurality of card-like devices, each bearing indicia. The first plurality of card-like devices, include indicia depicting various arithmetic symbols, while the second plurality of card-like devices include indicia representing numerals. The symbol bearing cards determine the method of play of the game in which the numeral bearing cards may be matched, added, subtracted, multiplied, divided, or deleted from play, in accordance with a method of play determined by the rules of the game.

9 Claims, 4 Drawing Figures

ARITHMETIC CARD GAME METHOD

BACKGROUND OF THE INVENTION

Field of the Invention

This invention relates to playing cards used for educational purposes.

In order to induce children, especially, to practice arithmetic concepts among themselves without the aid of a teacher, the present invention makes such an endeavor more fun. Children, even adults, like to play games, and many like to play card games. The present invention uses as its basis the idea of a deck of playing cards, and specifies a simple imprinting of numbers on the face of each playing card. The game utilizes the numbers and arithmetic operations in matching, building or stealing card game operations for fun and drill.

Prior educational games and card games use numerals printed in some specified combination on the cards. None, however, utilize such a straightforward use of individual numbers on the face of each card in the deck without distracting printed directions on the cards. For example, U.S. Pat. No. 1,699,629, issued to Phifer on Jan. 22, 1929 for an educational card game divided into three types of cards, those directing the player to "add", those directing the player to "subtract" and those directing the player to "multiply" only certain specified numbers on the same card. Thus, the instruction and playing cards were not interchangeable or separate; and the players could not use their decisional ability to select any desired arithmetic operation to be used in conjunction with the numbers on the cards.

SUMMARY OF THE INVENTION

Therefore, the present invention contemplates a simple design and manufactured set of playing cards with numbers on the playing card faces and mathematical symbols on the instruction cards, for fun and drill in basic arithmetic operations.

It is therefore an object of this invention to overcome the limitations and disadvantages in the games of the prior art.

One of the objects of the invention is to provide a game embodying improved principles of design and construction.

Another object of the invention is to provide an easy to learn and use card game whose educational purpose is to provide a means for drill in the basic arithmetic operations of addition, subtraction, multiplication, and division.

A further object of the invention is to specify card game operations on separate cards, that can be performed on the separate playing cards, which make the learning of the arithmetic itself fun because the playing of the card game itself is fun. Some of these card game operations are laterally familiar to children who have played other card games, and it is seen that their use in the practice of the present invention in a game, will impart some of the sense of excitement, surprise and suspense, which is a prime accompaniment to games played for amusement and diversion.

An arithmetic card game, according to the principles of this invention, comprises a deck or plurality of playing cards and a deck or plurality of mode indicator or mathematical instruction cards and a set of pertinent playing instructions.

Further objects and advantages of this invention will appear more clearly from the following description of a nonlimiting illustrative embodiment and the accompanying drawings in which like numerals designate like parts throughout the several views.

DESCRIPTION OF THE DRAWINGS

Briefly summarized, a preferred embodiment of the invention is described in conjunction with the illustrative disclosure thereof in the accompanying drawings, in which.

DESCRIPTION OF TYPICAL EMBODIMENT

Figure 1:
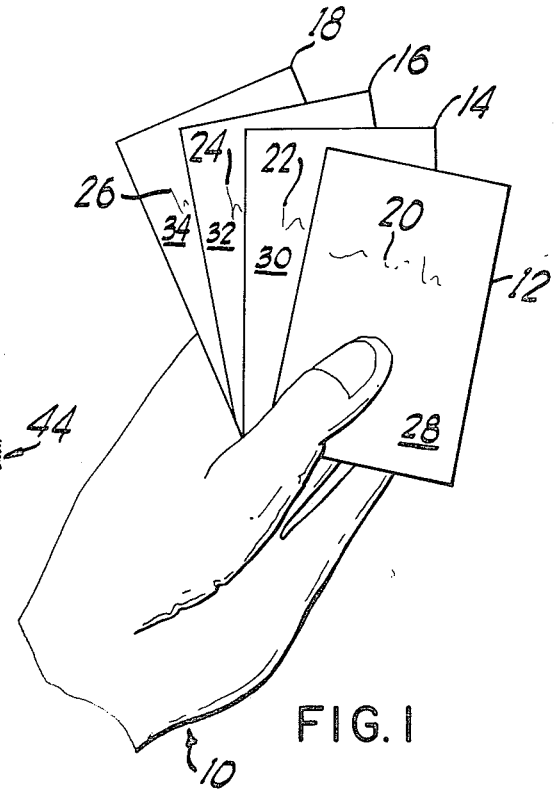
FIG. 1 is a front elevation view of a hand of cards, such as may be carried by the hand of a player, in a use position.

In the drawings, and specifically in FIG. 1, hand 10 is shown depicting cards 12, 14, 16, and 18, such that indicia 20, 22, 24, and 26, shown on surfaces 28, 30, 32, and 34 respectively, of cards 12, 14, 16, and 18 respectively, are all viewed by the viewer, whose hand is shown, whilst precluding others from indicia 20, 22, 24, and 26, in conventional card playing situations.

Figure 2:
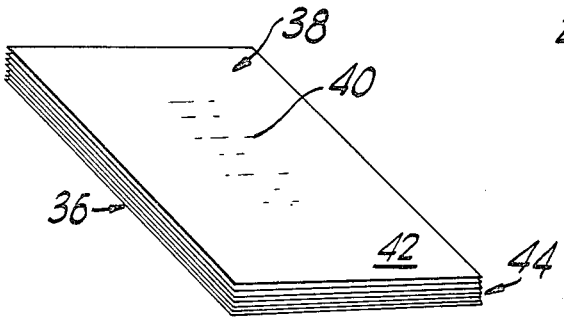
FIG. 2 is a perspective view of a plurality of playing cards arranged in a pile, such that the indicia, carried by an uppermost face of each of the cards, is concealed by cards arranged thereabove.

FIG. 2 illustrates a typical pile of cards 36, shown having uppermost card 38, which carries indicia 40 on uppermost lateral surface 42. Other cards, shown below card 38, carries similar indicia on their uppermost surfaces, comprising the remaining cards 44 of pile 36.

Figure 3:
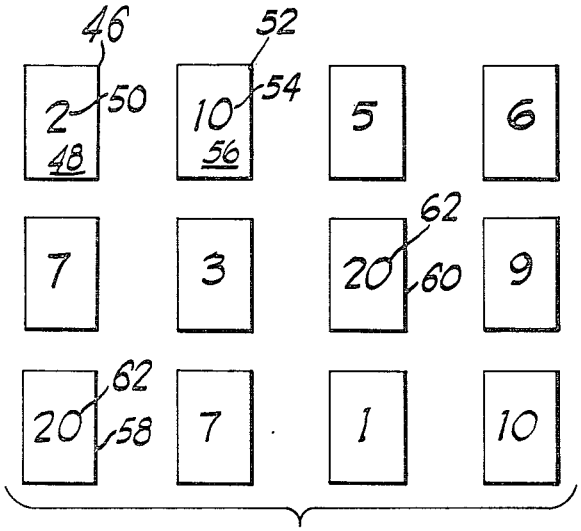
FIG. 3 is a front elevation view of a plurality of cards, each bearing diverse numerical indicia.

FIG. 3 illustrates a plurality of cards, such as cards 46 and 52, each carrying indicia, such as 50 and 54 respectively, on lateral surfaces 48 and 56 respectively. It should be noted that none of the numerical indicia, as depicted in FIG. 3, includes the symbol for zero nor are minus or plus signs shown. It is intended that the numerical indicia, typified by indicia 50 and 54, be a sequence of whole numbers, commencing from the number 1 all the way up to 20, 40, or if desired, higher. Further, cards 58 and 60 are shown to have identical indicia 62, namely, numeral 20. Thus, all of the numeral bearing cards, depicted in FIG. 3, may have two or more identical cards of the variety carrying the same numeral thereon, and can extend in the range to include each of the successive whole numbers, over any selected range. Naturally, if desired, the indicia may be selected to exclude any one given number, such as, say, the numeral 4. The salient feature of the numeral bearing cards, depicted in FIG. 3, is that the indicia thereon must be a whole positive number and a wide variety of such whole positive numbers, exclusive of any symbol for zero.

Figure 4:
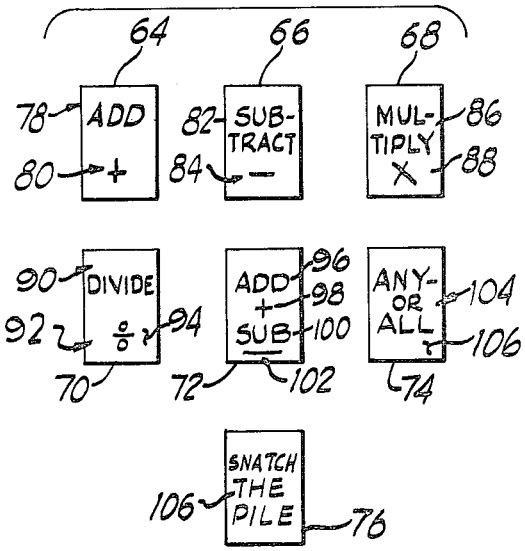
FIG. 4 is a front elevation view of a plurality of numerical instruction cards, some bearing arithmetic signs and some bearing word indicia.

FIG. 4 depicts another plurality of cards 64, 66, 68, 70, 72, 74, and 76. Here, each of such cards bear indicia as well, on one lateral surface of each such card. Though various forms of indicia may be employed, the indicia described on cards 64, 66, 68, and 70, must depict or convey the meaning of the arithmetical steps of adding, subtracting, multiplying, and dividing, respectively. By way of example, indicia 78, carried on card 64, is the word "add". However, indicia 80, also carried by card 64 utilizes or depicts a plus sign, symbolizing the step of adding. In like fashion, indicia 82, spells out, in word form, the step of subtraction, as does the sign 84, being a minus sign. Again, similarly, indicia 86 and 88 spell out in word and sign form, the steps of multiplication for card 68. Indicia 90 and 92 spell out the instructions to divide on surface 94 of card 70. Card 72 carries indicia 96, 98, 100, and 102, which depicts arithmetic operations in various forms, and as specifically shown, the word "add", is utilized for indicia 96, in conjunction with the plus sign, shown as indicia 98. Indicia 100 illustrates the word "subtract" by utilizing the phrase "sub" whilst indicia 102 is a minus sign. Therefore, card 72 is, as shown, a mathematical instruction card which carries two or more mathematical instruction indicias, such as carried by cards 64, 66, 68, and 70. Card 74 carries indicia 104 on surface 106 thereof such indicia illustrating or conveying the meaning that any or all of the mathematical instructional indicia, such as carried on cards 64, 66, 68 and 70, may be selected by a user, as desired. Indicia 104 explicitly utilizes the phrase "any or all", but equivalent words or symbols may by utilized. Card 76 carries indicia 106 which, as shown, utilizes the words "Snatch The Pile". Such words "Snatch The Pile" are descriptive of an operation, later to be described herein, which depicts a game operation such as removing a pile of cards, then in play, such that when card 76 is turned, the game to be played follows a set of rules, involving a player taking a deck of cards or "snatching" such a deck of cards, in accordance with the game rules hereinbelow described.

All of the figures, and specifically FIGS. 3 and 4, are representative insofar as the exact numerals selected or shown and insofar as the words and signs illustrated. However, the general meaning, or, standard meaning of numerals, being whole and positive, is a requirement for the indicia on each of the cards shown on FIG. 3, and, the meaning, as is well known, for the mathematical steps of adding, subtracting, multiplying and dividing, must be employed in whatever form desired, for cards 64, 66, 68, and 70, whilst two or more such similar mathematical signs may be depicted on card 72. Card 74, however, can convey, in any desired form, that any one or more of the cards in the group 64, 66, 68, or 70, may be utilized, or the mathematical sign carried thereon may be utilized, in the game to be played. Card 76 may utilize any form of indicia symbolizing the step of removing a pile of cards, in accordance with the rules hereinbelow described. As long as the indicia carried by the cards shown in FIG. 3 and the cards shown in FIG. 4 comply with the above requirements, then any form of indicia, as to color, size, character, word choice, symbols, or the like may be employed. The pile, shown in FIG. 2, may constitute the cards shown in FIG. 3 or FIG. 4, whilst the cards constituting cards 12, 14, 16, and 18, shown in FIG. 1, may constitute preferably the cards included within FIG. 3. FIG. 3 may have, though not shown, picture cards included within the plurality of playing cards comprising the cards shown in FIG. 3. Such picture cards include the conventional Jack, Queen, and King, seen in ordinary playing cards, as indicia rather than the numerals depicted by indicia 50, 54, 62, as well as the other numeral indicia shown. In order to more properly understand how the method and apparatus depicted in FIGS. 1–4 may be utilized, a set of rules, for playing a game therewith, is provided. They may include the following information:

Each game method and apparatus includes two decks or cards; the playing cards and the indicator cards. The playing cards may consist of 104 cards. If 104 cards, then those 104 cards include 4 different suits of each card type, imprinted with the arabic numerals 1 through 20, inclusive and two sets of picture cards (Jack, Queen, King). Thus, each of the 4 suits is comprised of 26 cards; one set of numerals 1–20 and two sets of 3 picture cards each, for a total of 104 playing cards.

The other deck includes one set of 7 indicator cards. The indicator cards instruct the players as to which mode of play they are to use for any particular deal in a single game game play. Each indicator card directs the players to use one of the seven possible modes of playing the game for the duration of that particular single game play. The indicator cards always are to be kept separately from the rest of the "playing" deck and are to be used only before the start of play of each game play. The indicator cards are then reserved for the next game play, and only the playing cards are used once the mode of the play has been selected.

In dealing the cards, one player shall be designated first dealer by mutual consent or by lot, whichever is preferred by the majority of players. (The game may be played by two or more players.) Dealing shall then rotate in a clockwise direction at the start of each new game play in the game. The dealer shall shuffle all cards—both the playing deck and the indicator cards—being careful to keep the two decks completely separate at all times. He shall then set the indicator cards in a pile on the playing surface and shall set the deck of playing cards in a separate pile on the playing surface, each having their indicia bearing surfaces face down. The player directly to the left of the dealer shall select the topmost indicator card from the pile of indicator cards, and display it face up for all players to see. This indicator card shall remain face up throughout the deal. If the mode of play is selected by mutual consent, the use of the indicator cards, as described here, may be dispensed with, or, the appropriate indicator card may be manually selected from the pile of indicator cards and placed face up on the pile of indicator cards. The dealer then deals out four cards to each player, and eight cards, face up, to the board. A game play commences with the player directly to the left of the dealer. After all players have used up or thrown in their cards, the dealer again deals four cards to each player.

This procedure continues until all cards are used up. When all the cards are used up, a single game play is concluded. At the end of every game play, scoring proceeds. The next dealer then repeats the process until the selected number of game plays have been concluded, and the winner is then determined. Where the skill and arithmetic experience of the players permits, the mode of play shall be changed for each deal of a game, either by the arbitrary selection and use of one of the indicator cards or by mutual consent of the players.

As can be seen, the players have the option of choosing the mode of play in one of two ways: by mutual consent--agreement of the players in advance of any deal; or by the random selection of the indicator cards, as described. The mode of play, determined by mutual consent of the players, or otherwise, is obviously advantageous for very young players, who may be acquainted with one or two arithmetic operations, and must of necessity, ignore any of the other modes, and for any prescriptive uses of the game, such as in a formal classroom, where the teacher selects the mode for drilling purposes. Ordinarily, however, the use of a random selection of the indicator cards adds to the excitement and entertainment value of the game and is to be preferred whenever possible, the age and skill of the players permitting.

In the event indicator card 76 is selected, to determine the mode of play, then the words "snatch the pile" or, if desired, the word "Match" or "Equal", being the form of indicia that may be carried on card 76, instruct the players to match or equal the cards that have the same face value, either having numerical indicia or pictorial indicia thereon, regardless of suit. To match the cards that have the same face value either having numerical indicia or pictorial indicia, thereon, regardless of suit, each player may match any card on the playing surface with a similar card from his hand. He then takes both cards, that is, from the table and from his hand, and places them face up, showing the indicia side up, on his pile of cards. Any other player, provided it is his turn to play, may again match the top card of any opposing player's pile and "Snatch The Pile", meaning, takes the opposing players pile of cards, appropriating the entire pile as his own. The top card of every players pile must remain face up during play.

In the event it is decided to utilize only an adding step, or in the event that indicator card 64, shown in FIG. 4, is arbitrarily or accidentally selected, the players use the arithmetic operation of addition as the mode of play for the game play. The addition may be worked in either of two ways. First, the player may mentally add the arithmetic values of two cards on the board and use a card from his hand that has the sum of the two values on its face to complete the play—and add all three cards to his pile, or, the player, if the cards are conveniently arranged for him to do so, may mentally add the sum of one card on the board and another from his hand, and complete the play by using a card from the board whose face value is the sum of the two cards—and add all three cards to his pile. Players should verbalize the arithmetic operation they are performing—such as: "3 plus 2 equals 5" or "3 added to 2 makes 5", etc. This makes for immediate recognition of the play by all players, and emphasizes the educational value of the game for all players concerned. It generally also makes for a faster paced game, by keeping all players' attention on the current play at the moment it is made. In the event excitement is to be increased, especially with players of a young age, a mental rule may be required wherein each of the players must verbalize the arithmetic operations, before removing the cards and adding same to his own pile. Failure to do so, and in correct arithmetical form, will constitute a penalty of causing such player to pass, thereby precluding his ability to gain the advantage of adding such cards to his pile.

In the event that card 66, shown in FIG. 4, is selected, or, in the event it is decided to utilize a mode of game play wherein only the arithmetic step of subtraction is to be employed, players must only use the arithmetic operation subtraction as the mode of play. The subtraction may be worked in any one of the following ways or equivalent variations thereof. First, the player may use both cards on the playing surface to compose the two acted upon cards, that is the subtrahend and minuend, and a card from his hand as the answer or remainder. He would thus say, for example, "5 minus 3 equals 2", while appropriating the 5 and 3 from the board and using the 2 from his hand to complete the play—and add all three cards to his pile. A second way of playing a simple game play by way of subtraction only, is by designating the subtrahend and remainder from the board and the minuend from the player's hand. For example, the player would say, "10 minus 6 equals 4", while appropriating the 10 from the board, the 6 from his hand, and the 4 from the board to complete the play and then adding all three cards to his pile.

In the event that card 68 is selected, by accident or by choice, the step of multiplication becomes the mode of play. The multiplication may be worked in any one of the following ways, or equivalent variations thereof. First, the player may use two cards from the playing surface as the multiplier and multiplicand, and one card from his hand as the product. For example, the player may use a 3 and a 2 from the board, and a 6 from his hand, saying, "3 times 2 equals 6", or, the player may choose a vaiation in which he uses the product and the multiplier from the board, and the multiplicand from his hand. For example, the player might use a 2 and a 6 from the board and a 3 from his hand, saying, "3 times 2 equals 6". Equivalent variations may be worked out by players which then become acceptable in a game play.

In the event card 70 is selected, or, it is decided to utilize the step of division, players use the arithmetic operation division as the mode of play. The division may be worked in any one of the following ways, or equivalent variations thereof. First, the player may use the divisor and the dividend from the board, and supply the quotient from his hand. For example, he might say, "6 divided by 3 equals 2", using the 6 and the 3 from the board, while supplying the 2 from his hand, or, the player might utilize the dividend and the quotient from the board, supplying the divisor from his hand. For example, the player might use a 6 and a 2 from the board and a 3 from his hand, saying, "6 divided by 3 equals 2". Equivalent variations of these suggestions may be utilized.

In the event that card 72, shown in FIG. 4, is selected or it is desired to use two arithmetic steps, such as the steps of addition and subtraction in one play, then, the players are so bound. For example, a player might say, "10 plus 2 minus 3 equals 9", and at the same time appropriate the 10, the 9, and the 3 from the playing surface, and the 2 from his hand, or, the player may use any equivalent variation thereof, but he must always use at least one card from his hand in the play. Four cards are used in Add and Subtract, while three cards are used in the modes of play described above. Another variation of the instant invention may include a substitute, or, if desired, an additional card, not shown, which carries an arithmetic sign or words describing the steps of multiplication and an arithmetic sign or words describing the arithmetic step of division. Other combinations of adding, subtracting, dividing, or multiplying, may be employed, as desired.

In the event card 74 is selected or in the event that the players are of sufficient skill and have the desire, then the mode of "Any and All" or "Free Play" may be used during the same game play by any of the players. Players must be certain to verbalize what they are doing as they do it; otherwise "Free Play" may become confusing to the other players. In the event that the "Free Play" mode is selected, the free play card, depicted by card 74, shown in FIg. 4, must be displayed.

Scoring may be done in any one of several ways at the conclusion of any single game play or at the conclusion of a number of game plays, dependent upon the age, skill, and interest of the players. The simpler methods are suitable for younger players, while older players and adults may prefer the challenge afforded by the more precise methods. A simple way of scoring is to accord the player with the most cards at the end of each game play the winning point for that game play. A whole game, typically, may consist of two or more game plays, to be determined in advance by mutual consent of the players, or, in the case of a formal classroom game, by the teacher, if this is so desired. Scoring may be accomplished by adding up the scores for each individual game play at the end of a whole game so as to determine the overall winner.

Another way of scoring, is to accord all digital cards below the numeral "6" 5 points each, and all digital and picture cards with the numeral "6" or above 10 points each. The winning player of any game play, therefore, would be the player with the highest number of points of the game play, not necessarily the player with the most cards. It is clear that this method of scoring accords more value for thought during play then mere luck. Players will be more careful to select the cards with the higher face values, if possible, and the game thus becomes more challenging. Still another method of scoring, is to accord each digital card its face value, and each picture card 10 points. Obviously, other scoring techniques may be employed, all dependent upon the number of cards that each player ends up with and their point value.

Each of the cards, shown in FIGS. 3 and 4, as well as the pile of card 36, shown in FIG. 2, and cards 12, 14, 16, and 18, as shown in FIG. 1, may be constructed of any material, such as cardboard, plastic, metal, or the like, having a generally rectangular shape, if desired, and may, if desired, carry braille symbols, for use by the blind. The other surfaces, not shown, of the cards illustrated in FIGS. 1–4, may be conventional playing cards such that the playing cards comprising the 104 cards constituting the preferred embodiment herein, so as to make up two complete sets of playing cards, each generally being of a different color than the other, by way of different border. In this fashion, two conventional playing card sets may be utilized, when not playing the game described herein, whilst, when combining such cards into a set of 104, a complete set of 104 playing cards may be constituted so as to play the game in accordance with the foregoing rules.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

What is claimed is:

1. A method of playing an educational card game comprising the step of concealing from the view of at least two players the numerical indicia carried by a first plurality of playing cards, the step of stacking said first plurality of cards, into a pile, the step of dispensing from said pile four cards of said first plurality of cards to each of said at least two players wherein said indicia of said first plurality of cards so dispensed is in view of each of said at least two players, the step of dispensing eight of cards of said first plurality of cards onto a playing surface wherein said indicia carried by said first plurality of cards are in view of said at least two players, the step of randomly selecting one of the cards of a second plurality of playing cards wherein at least some of said second plurality of cards carry indicia, said indicia carried by said second plurality of cards indicating an arithmetical process, the step of one of said at least two players removing at least one card from said eight cards and removing at least one card from said four cards and arithmetically utilizing only said arithmetical process denoted by said indicia carried by said second plurality of cards with said numerical indicia disposed on said at least one of said eight cards and placing said at least one card from said eight cards and said at least one card from said four cards into another pile adjacent said player, said arithmetical process comprises the steps of addition, subtraction, multiplication, and division.

2. The method as claimed in claim 1 further comprising the step of scoring said cards in said another pile.

3. The method as claimed in claim 2 further including the step of adding the number of cards disposed adjacent each of said at least of two players.

4. The method as claimed in claim 2 further comprising the step of adding together the value of each of the numerical indicia disposed adjacent each of said at least two players.

5. The method as claimed in claim 1 wherein said arithmetical process comprises only the steps of addition and subtraction.

6. The method as claimed in claim 1 further comprising the step of said one of said at least two players taking said other pile disposed adjacent the other of said at least two players for combination with said other pile adjacent said one player of said at least two players.

7. The method as claimed in claim 1 wherein said arithmetical process comprises selectively the steps of addition, subtraction, multiplication, and division.

8. The method as claimed in claim 1 wherein said arithmetical process comprises selectively any and all the steps of multiplication, division, addition, and subtraction.

9. The method as claimed in claim 1 comprising the step of selection includes selectively the steps of arbitrary selection of one of said plurality of second playing cards and a consensual selection of said one of said second plurality of playing cards by mutual agreement of said at least two players.

* * * * *